US007275279B2

(12) United States Patent
Genoa et al.

(10) Patent No.: US 7,275,279 B2
(45) Date of Patent: Oct. 2, 2007

(54) VACUUM CLEANER WAND ADAPTERS AND HANDLE ASSEMBLIES INCLUDING THE SAME

(75) Inventors: Mark Genoa, Melville, NY (US); Scott Genoa, Merrick, NY (US); Joseph Genoa, Boca Raton, FL (US)

(73) Assignee: Nationwide Sales & Service, Inc., Farmingdale, NY (US)

( * ) Notice: Subject to any disclaimer, the term of this patent is extended or adjusted under 35 U.S.C. 154(b) by 1 day.

(21) Appl. No.: 11/055,209

(22) Filed: Feb. 10, 2005

(65) Prior Publication Data

US 2006/0174442 A1 Aug. 10, 2006

(51) Int. Cl.
*A47L 5/38* (2006.01)

(52) U.S. Cl. ..... 15/314; 15/377; 15/414

(58) Field of Classification Search ..... None
See application file for complete search history.

(56) References Cited

U.S. PATENT DOCUMENTS 4,345,805 A 8/1982 Finley et al.
4,494,270 A * 1/1985 Ritzau et al. ..... 15/377
4,550,958 A 11/1985 Smith
4,963,100 A 10/1990 Genoa et al.
4,969,837 A 11/1990 Genoa et al.
5,462,311 A 10/1995 Cipolla
5,472,346 A * 12/1995 Gray et al. ..... 439/23
5,551,731 A 9/1996 Gray et al.
5,575,509 A 11/1996 Wood et al.
5,755,578 A 5/1998 Contant et al.
6,015,298 A 1/2000 Linhart
6,108,861 A 8/2000 Vystrcil et al.
6,237,962 B1 5/2001 Lim

* cited by examiner

*Primary Examiner*—David Redding
(74) *Attorney, Agent, or Firm*—Frishauf, Holtz, Goodman & Chick, P.C.

(57) ABSTRACT

Vacuum cleaner wand adapter for coupling a vacuum cleaner handle to a wand implement of the vacuum cleaner including a housing defining an inner passage for receiving part of the handle and part of the wand implement, a first locking mechanism arranged on the housing for releasably locking the handle to the housing, and second locking mechanism arranged on the housing for releasably locking the housing to the wand implement. An electrical contact structure is also preferably provided to enable the wand adapter to be electrically connected to existing wand implements and handles.

29 Claims, 6 Drawing Sheets

VACUUM CLEANER WAND ADAPTERS AND HANDLE ASSEMBLIES INCLUDING THE SAME

FIELD OF THE INVENTION

The present invention relates generally to vacuum cleaner wand adapters and handle assemblies including the same, and more particularly to wand adapters which are capable of interconnecting a vacuum cleaner wand or accessory and a handle of the vacuum cleaner.

BACKGROUND OF THE INVENTION

A vacuum cleaner typically includes a canister housing connected through a hose to a handle which in turn is connected to a power nozzle through a wand assembly. The wand assembly includes an adapter which enables its connection to the handle. The handle typically includes an outwardly extending metal tube with a swaged male end receivable in an expanded female end of the wand adapter. Electrical connectors are provided in the handle and wand adapter to enable electrical connection therebetween when the wand assembly is connected to the handle.

The wand adapter can be connected to a tubular part of the wand assembly which connects to the power nozzle or alternatively to other cleaning implements or accessories. Hereinafter, the tubular part or other cleaning implements or accessories to which the wand adapter is connected will be referred to as wand implements.

OBJECTS AND SUMMARY OF THE INVENTION

It is an object of the present invention to provide vacuum cleaner wand adapters which are easy to manufacture and thus have a relatively low cost, and vacuum cleaner handle assemblies including a handle and such an adapter and vacuum cleaner wand assemblies including such an adapter and a wand implement.

It is another object of the present invention to provide a wand adapter for a vacuum cleaner which releasably locks to both a wand implement and to a handle of the vacuum cleaner.

In order to achieve these objects and others, an adapter in accordance with the invention for coupling a handle of a vacuum cleaner to a wand implement of the vacuum cleaner comprises a housing defining an inner passage for receiving part of the handle and a part of the wand implement, a first locking mechanism arranged on the housing for releasably locking the handle to the housing, and second locking mechanism arranged on the housing for releasably locking the housing to the wand implement. By providing two releasable locking mechanisms on the housing, the adapter is separable from both the wand implement and the handle so that it can be replaced if damaged without necessitating replacement of the handle or wand implement. Similarly, if the handle is damaged, only the handle can be replaced without necessitating replacement of the wand adapter.

The first locking mechanism includes a release catch having a pressure-application portion at one end and a catch at an opposite end. The release catch is pivotally mounted to the housing and preferably biased such that the catch passes into the passage and is capable of entering into an opening formed on a metal tube projecting from the handle when such a handle is present in the passage and the opening on the handle aligns with the catch. When the catch is situated in the opening on the handle, removal of the handle from engagement with the adapter is prevented thereby securing the handle to the adapter. Separation of the handle from the adapter is possible by pressing the pressure-application portion of the release catch to cause the catch to be raised out of the opening in the handle after which, the handle and adapter can be pulled apart from one another.

The release catch may be pivotally mounted to a mounting projection of a locking part of the housing and a leaf spring arranged within the mounting projection, and between the pressure-application portion of the release catch and the outer surface of the locking part, to bias the pressure-application portion away from the locking part and thus the catch into the opening on the handle. Other ways to bias the catch to enter into the passage and thus into the opening on the handle when present in the passage are also envisioned within the scope and spirit of the invention.

The mounting projection may be accommodated in an axially extending slot formed in the housing. The catch passes through this slot to enter into the passage.

The second locking mechanism may comprise a leaf spring member and a release button for actuating the leaf spring member. The leaf spring member is mounted to the housing at a first end and has a hook at a second, opposite end. The leaf spring member is preferably biased to urge the button away from the passage and thus the hook into the passage. The button actuates the leaf spring member between the first and second ends upon being pressed toward the passage to cause the second end and thus the hook to move outward from the passage. To provide for this operation of the leaf spring member, the housing includes a support ledge over which the leaf spring member extends such that the hook is on one side of the support ledge and a location at which the button exerts pressure against the leaf spring member is on an opposite side of the support ledge.

The hook is arranged at the end of an axially extending slot into which a projecting block of the wand implement slides during engagement of the adapter with the wand implement. The hook slides over the projecting block during engagement and thus the adapter cannot be separated from the wand implement unless and until the release button is pressed inward toward the passage to raise the hook above the projecting block.

Another important aspect of the invention is that the adapter is capable of coupling a handle to a wand implement of a vacuum cleaner having a particular design of electrical contacts. The design includes two elongated metal prongs situated a distance apart from one another on the wand implement. To this end, a coupling part of the housing includes channels in which conductive, tubular contacts are arranged. The tubular contacts are electrically connected to wires which extend from a connector on the housing which connects to conductors running along the handle. The tubular contacts have an open interior space into which the prongs on the wand implement are accommodated and are dimensioned such that the prongs are in contact with the tubular contacts when the wand implement is situated partly in the passage in the adapter to thereby establish electrical connection.

A vacuum cleaner handle assembly in accordance with the invention includes a handle having a metal tube projecting from one end thereof, and possibly having two elongate tubular portions at an angle to one another, at least one circumferential opening formed on the metal tube proximate an end thereof and an adapter as in any of the above-described constructions for coupling the handle to a wand implement.

A vacuum cleaner wand assembly in accordance with the invention includes a wand implement, e.g., a tubular wand part or a cleaning implement or accessory, and an adapter as in any of the above-described constructions for coupling the wand implement to a vacuum cleaner handle.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
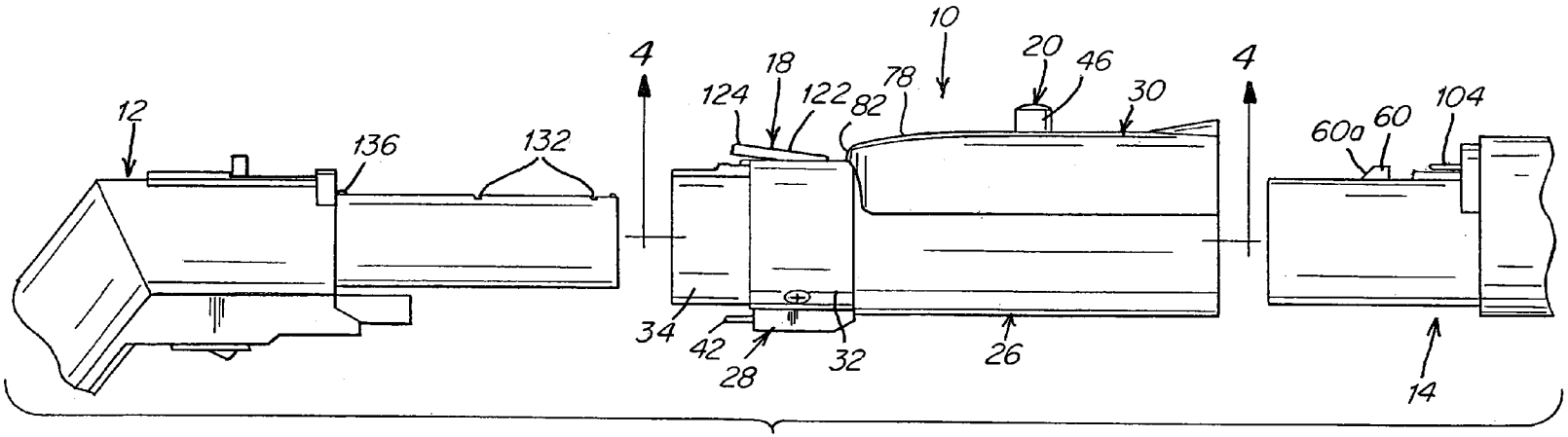
FIG. 1 is a perspective view of a vacuum cleaner wand adapter according to the present invention for coupling a wand implement to a handle of a vacuum cleaner.
Figure 3:
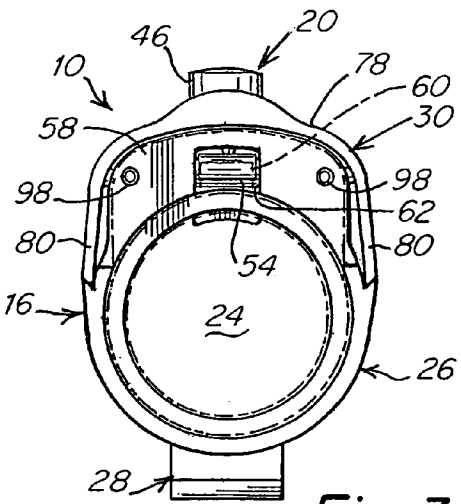
FIG. 3 is a front elevational view of the wand adapter of FIG. 1.

Referring first to FIGS. 1-7, a first vacuum cleaner wand adapter 10 in accordance with the invention for coupling a handle 12 to a wand implement 14 generally comprises a housing 16, a locking mechanism 18 arranged on the housing 16 for releasably locking the handle 12 to the housing 16, and a locking mechanism 20 arranged on the housing 16 for releasably locking the housing 16 to the wand implement 14. Housing 16 defines an inner through passage 24 whereby during use of the adapter 10, the wand implement 14 is situated in a front end of the passage 24 and the end of the handle 12 enters into a rear end of the passage 24 (see FIG. 4). A suction passage is thereby formed from the wand implement 14, through the passage 24 in the housing 16 to the handle 12, and debris and particulate matter picked up by the wand implement 14 are drawn through this suction passage into the vacuum cleaner housing.

Figure 7:
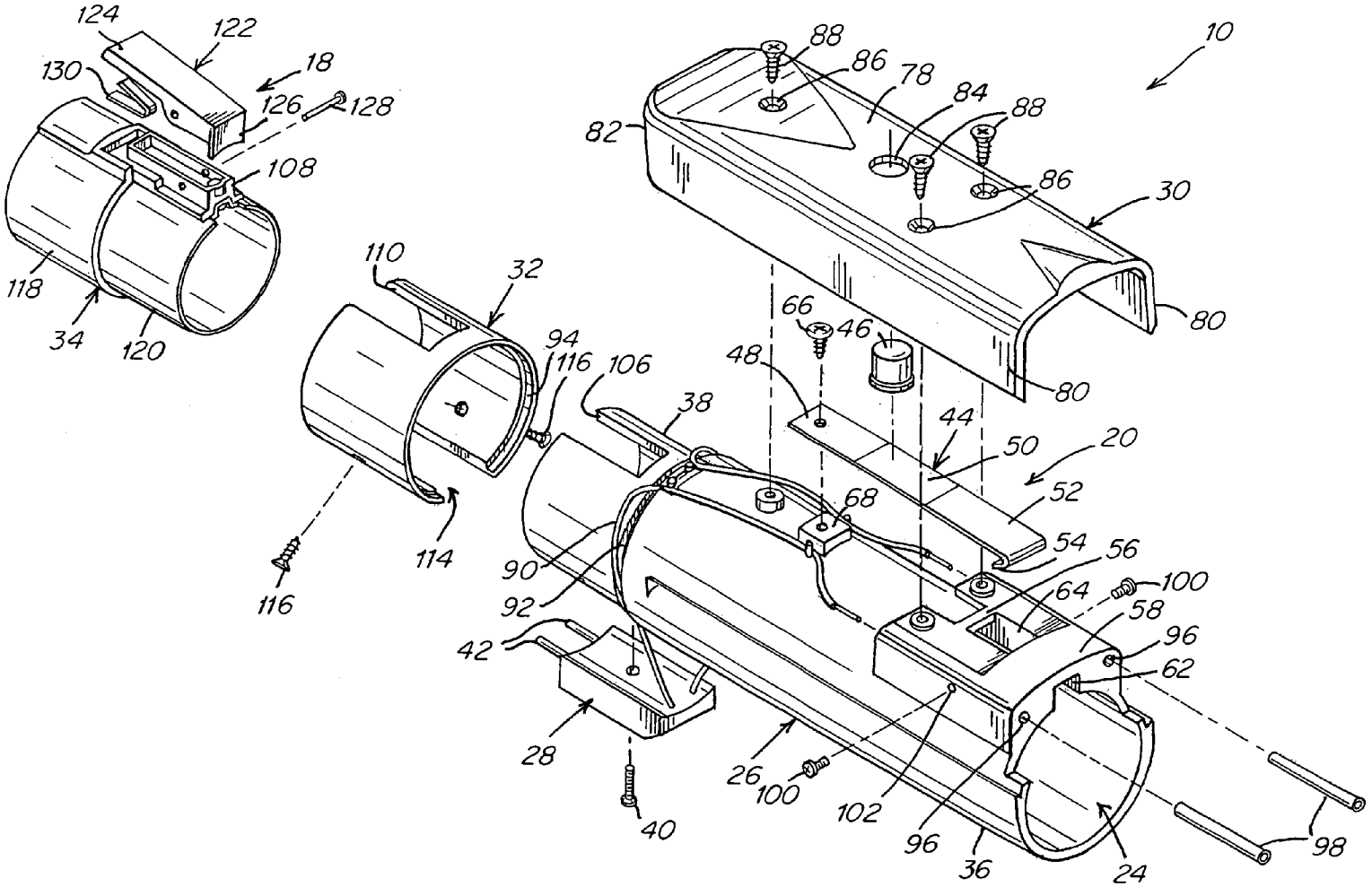
FIG. 7 is an exploded view of the wand adapter of FIG. 1.
Figure 8:
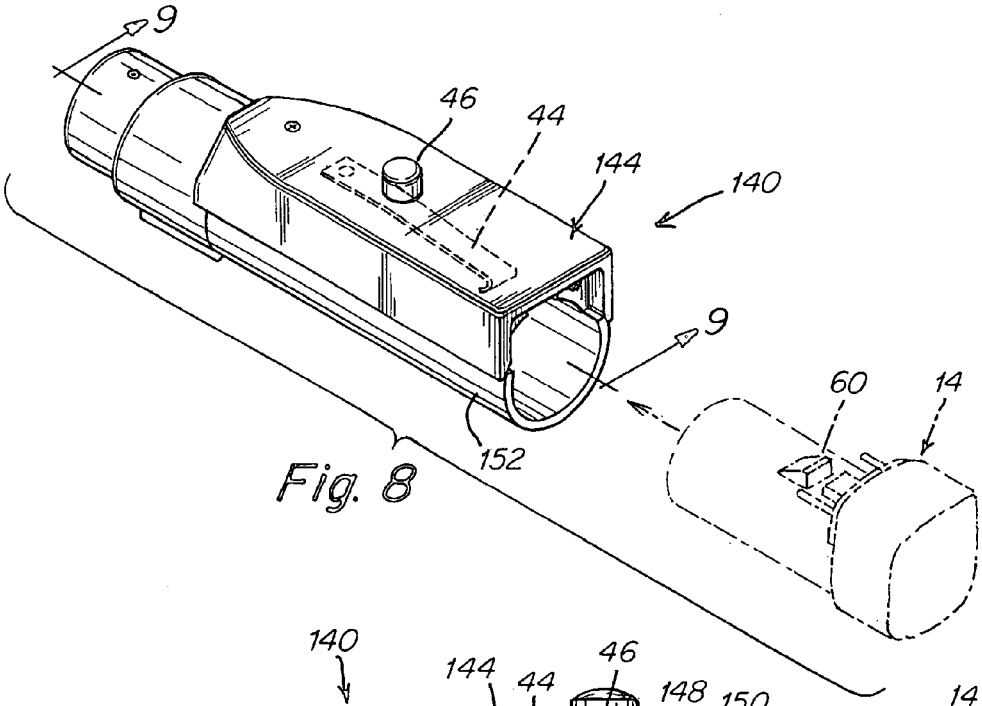
FIG. 8 is a perspective view of another embodiment of a wand adapter according to the present invention.
Figure 9:
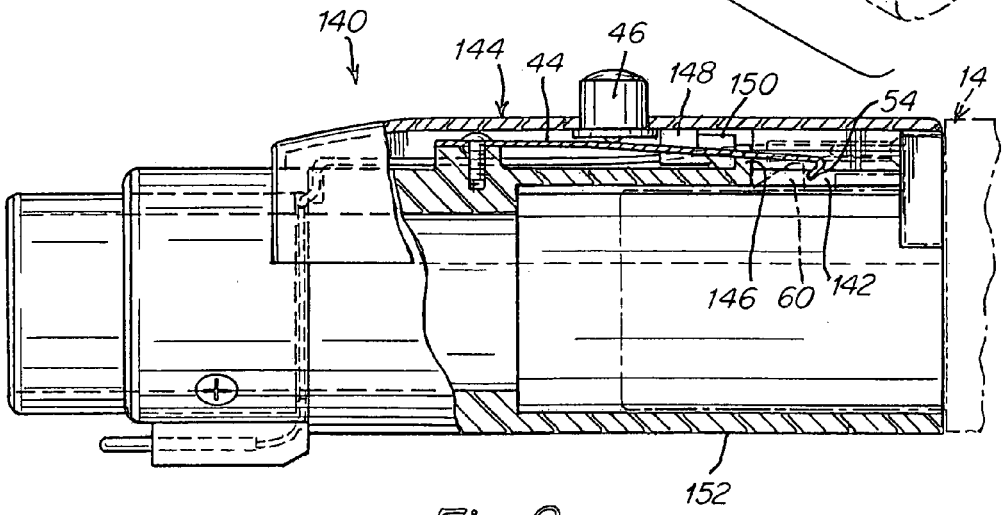
FIG. 9 is a side elevational view of the wand adapter of FIG. 8 when coupled to a wand implement (shown in phantom lines) and partially broken away to show internal structure.
Figure 10:
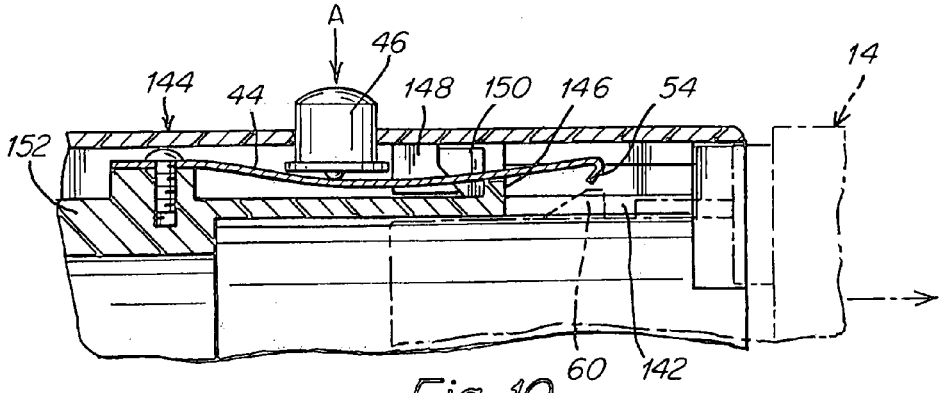
FIG. 10 is a sectional view of the wand adapter of FIG. 8.
Figure 11:
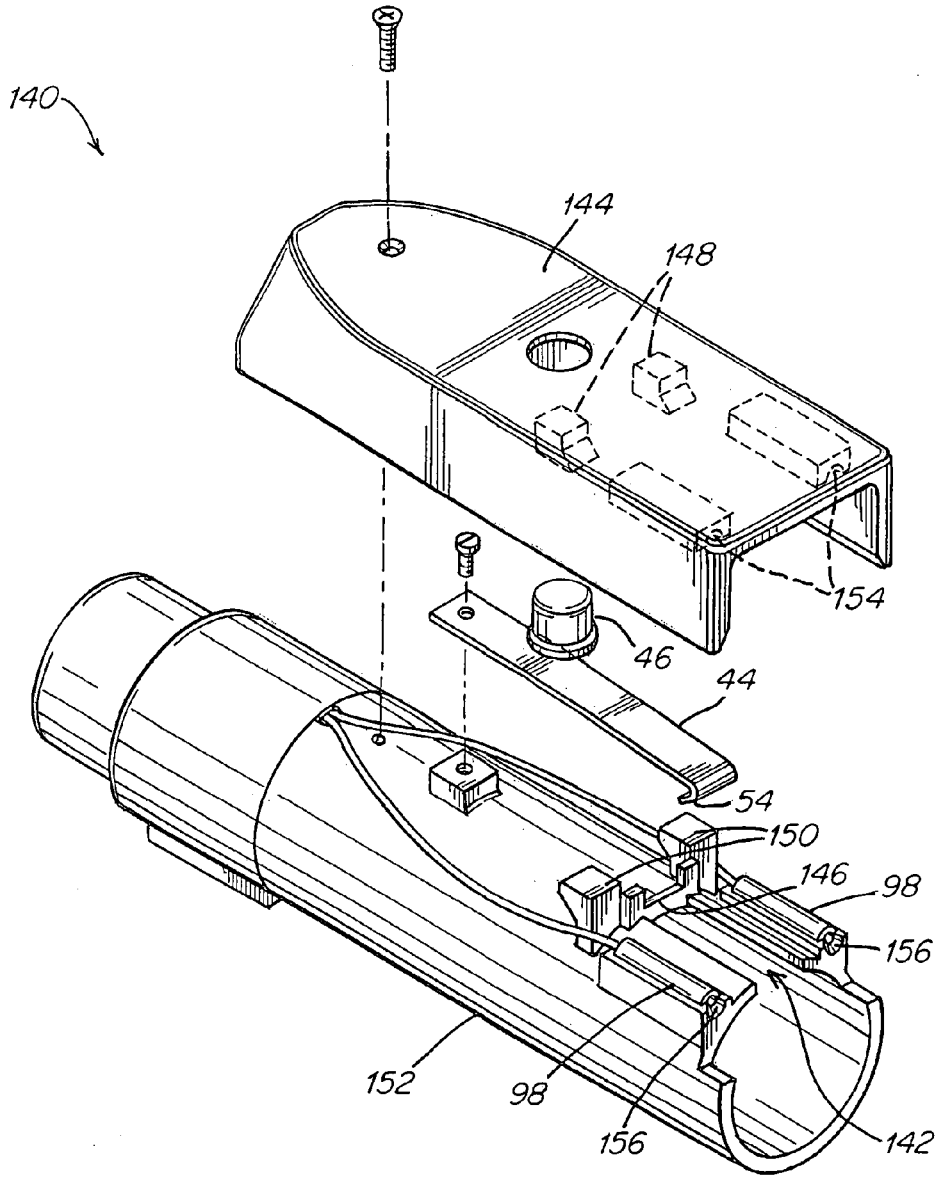
FIG. 11 is an exploded view of the wand adapter of FIG. 8.
Figure 12:
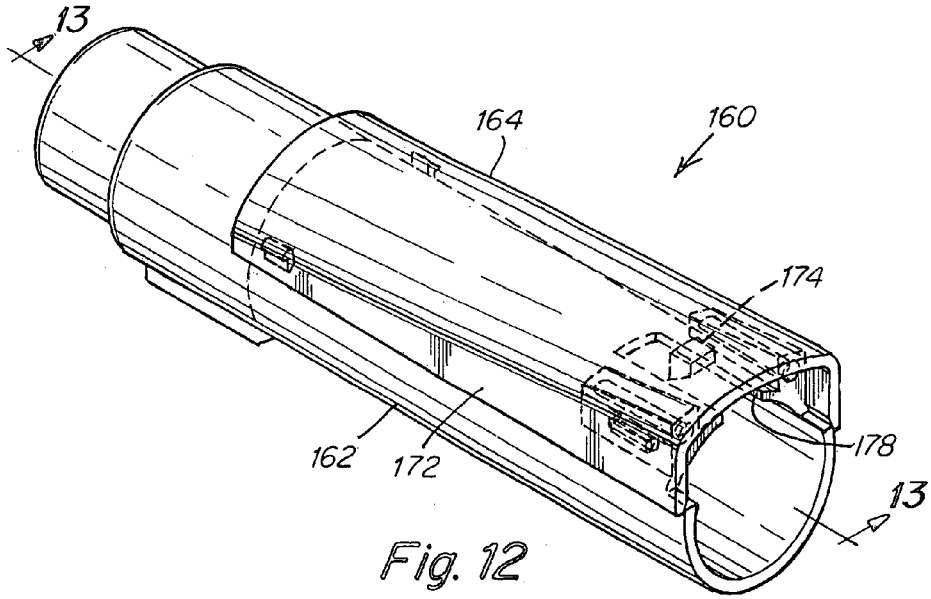
FIG. 12 is a perspective view of another embodiment of a wand adapter according to the present invention.
Figure 13:
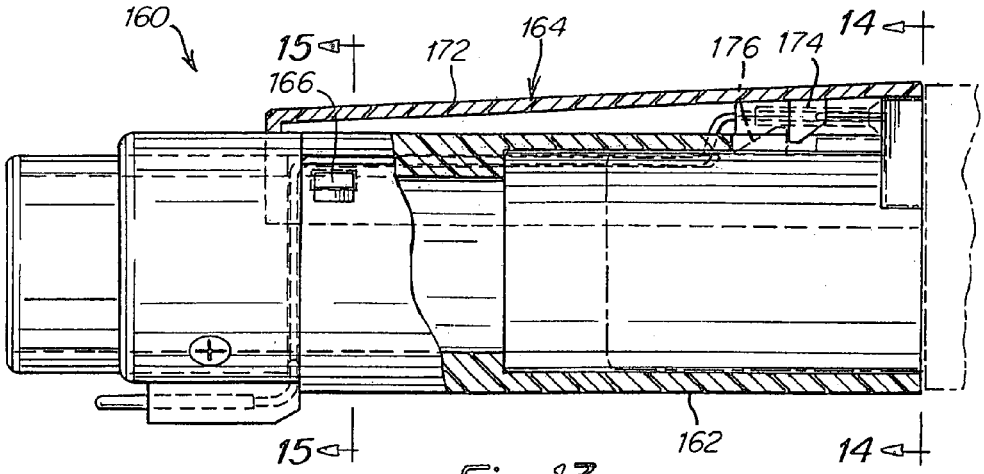
FIG. 13 is a side elevational view of the wand adapter of FIG. 12 when coupled to a wand implement (shown in phantom lines) and partially broken away to show internal structure.
Figure 14:
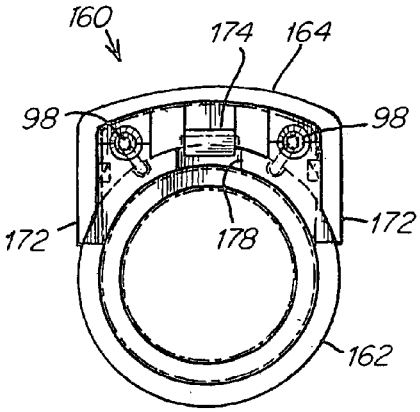
FIG. 14 is a sectional view taken along the line 14-14 in FIG. 13.
Figure 15:
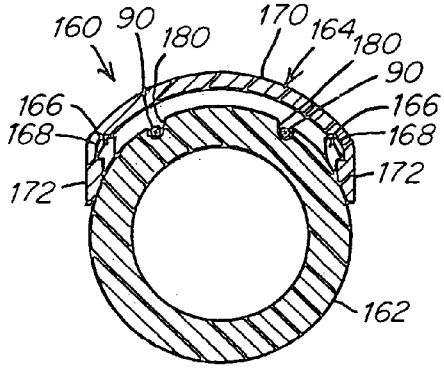
FIG. 15 is a sectional view taken along the line 15-15 in FIG. 13.

Referring to FIG. 7, housing 16 includes a substantially tubular member 26 on which an electrical connector 28 is arranged, a shroud or cover 30 removably connected to the member 26 and partially enclosing the locking mechanism 20 when connected to the member 26, a C-shaped wire-retaining member 32 and a locking part 34 having the locking mechanism 18 arranged thereon.

Member 26 has a first substantially tubular portion 36 situated at the front of the member 26 and a second substantially tubular portion 38 having a smaller diameter than the first tubular portion 36 and situated at the rear of the member 26. Connector 28 is attached via a screw 40 to the outer surface of second tubular portion 38 such that electrical contacts thereof, i.e., metal prongs 42, extend rearward. Prongs 42 have a shape and size to enable interconnection with female receptacles on the handle 12. Prongs 42 may be provided with different shapes and sizes to be compatible with different manufacturers' vacuum cleaner handles.

Locking mechanism 20 comprises a thin, elongate leaf spring clip or member 44 and a release button 46 arranged to actuate the leaf spring member 44. The leaf spring member 44 is biased to urge the button 46 against an inner surface of the cover 30, upward in the illustrated embodiment.

Leaf spring member 44 has an attachment portion 48 at one end at which the leaf spring member 44 is attached to the tubular member 26, a locking portion 52 arranged at the opposite end and an actuating portion 50 arranged between the attachment portion 48 and locking portion 52. Locking portion 52 has a rearward facing hook 54 arranged at the end thereof (see FIG. 7). Actuating portion 50 may be slightly angled relative to attachment portion 48 and the planar part of hook 54 may also be angled slightly relative to the actuating portion 50.

Locking portion 52 passes over and rests on a support ledge 56 formed on a coupling part 58 of the tubular member 26. Support ledge 56 constitutes a fulcrum designed so that downward pressure applied to the actuating portion 50, namely by depressing the button 46, causes rotational movement of the locking portion 52 about the support ledge 56 with the hook 54 being pivoted upward away from the passage 24.

Figure 4:
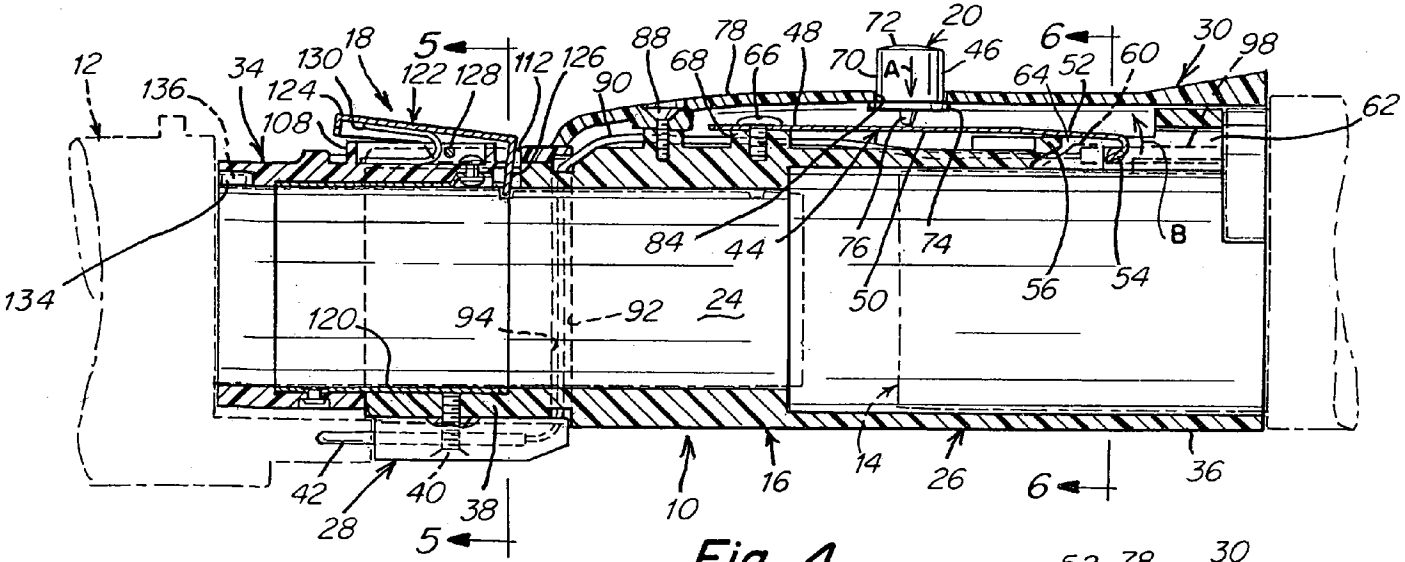
FIG. 4 is a sectional view taken along the line 4-4 in FIG. 1.
Figure 6:
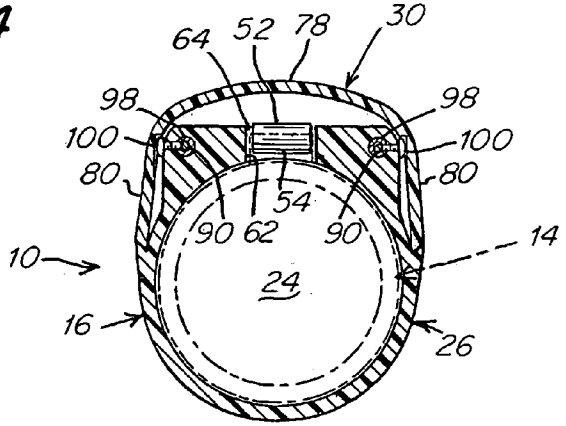
FIG. 6 is a sectional view taken along the line 6-6 in FIG. 4.

Hook 54 is designed to hook around a projecting block 60 formed on the wand implement 14 to prevent unintentional separation of the adapter 10 from the wand implement 14 and thereby secure the adapter 10 to the wand implement 14 (see FIG. 4). Projecting block 60 has an upwardly inclined surface **60*a* facing the rear end of the wand implement 14 which enables a front edge of the hook 54 to slide along the surface 60*a* and pass over the projecting block 60 during attachment of the adapter 10 to the wand implement 14. To facilitate engagement of the hook 54 beyond the projecting block 60 during attachment of the adapter 10 to the wand implement 14, the coupling part 58 is provided with a longitudinally extending slot 62 having a width sufficient to accommodate the projecting block 60 and an opening 64 communicating with the slot 62 and situated to enable the hook 54 to engage the projecting block 60 once the adapter 10 is slid onto the wand implement 14** a sufficient distance to ensure secure coupling thereto.

Attachment portion 48 of the leaf spring member 44 is attached to the tubular member 26 by an appropriate attachment mechanism, such as by a screw 66 passing through an aperture in the leaf spring member 44 and into an aperture in a screw engagement part 68 of the tubular member 26. Other mechanisms for securing the attachment portion 48 of the leaf spring member 44 to the tubular member 26 are also possible within the scope and spirit of the invention.

Button 46 has a substantially cylindrical portion 70, a rounded upper surface 72, a lower rim 74 projecting beyond the periphery of the cylindrical portion 70 and a protuberance 76 on a lower surface. Preferably, button 46 is positioned so that protuberance 76 engages the actuating portion 50 of the leaf spring member 44 (see FIG. 4).

Button 46 actuates the leaf spring member 44 to enable separation of the adapter 10 from the wand implement 14 in that by depressing the-button 46 in the direction of arrow A in FIG. 4, the actuating portion 50 is caused to move downward resulting in rotation of the locking portion 52 about the support ledge 56 (in the direction of arrow B) and the hook 54 to be raised above the projecting block 60. The adapter 10 and wand implement 14 are then separable from one another by pulling them apart.

Cover 30 includes an upper wall 78, side walls 80 and a front wall 82. Cover 30 engages with the tubular member 26 such that the side walls 80 are positioned alongside the sides of the coupling part 58 and the upper wall 78 substantially overlies the leaf spring member 44 (see FIG. 6). An aperture 84 is formed in the upper wall 78 through which the cylindrical portion 70 of the button 46 passes. Button 46 is retained in position in view of the lower rim 74 being provided with a larger circumference than the aperture 84. Additional apertures 86 are formed in the upper wall 78 to enable screws 88 to pass therethrough into engagement with threaded receptacles formed in the tubular member 26 and/or coupling part 58 thereof.

Referring again to FIG. 7, wires 90 are connected to the prongs 42 and pass through complementary wire channels 92, 94 defined by the member 26 and wire-retaining member 32, respectively, and then over the outer surface of first tubular portion 36 to the coupling part 58.

Coupling part 58 includes a pair of bores or through channels 96 into which the wires 90 pass from a rear opening. Tubular electrical contacts 98 are arranged in the channels 96. Contacts 98 are electrically connected to the wires 90 by arranging the wires 90 inside the tubular contacts 98 and tightening clamping screws 100, which are threaded into channels 102 in the coupling part 58, to thereby clamp ends of the wires 90 inside the tubular contacts 98 while at the same time fixing the tubular contacts 98 in the channels 96. Wires 90 can be guided in their passage over the outer surface of the first tubular portion 36, for example, by attaching them to the screw engagement part 68 formed on the outer surface (see FIG. 7).

The ends of the wires 90 extend only partially through the interior of the contacts 98 to leave a front portion of the interior of the contacts 98 open. This allows electrical contacts, such as metal prongs 104 of the wand implement 14, to enter into the interior of and contact the contacts 98 when the adapter 10 is connected to the wand implement 14. An electrical path between the prongs 104 of the wand implement 14 and the prongs 42 of connector 28 is thereby formed via the contacts 98 and wires 90.

The channels 96 are spaced apart a set distance in order to align with the prongs 104 of existing vacuum cleaner housings. In this manner, the adapter 10 can be coupled to existing wand implements.

At the opposite end of the housing 16 from locking mechanism 20, structure is provided to accommodate the handle 12 and locking mechanism 18. Specifically, the second tubular portion 38 of the tubular member 26 includes an axially extending slot 106 which receives a mounting projection 108 of the locking part 34 (see FIG. 7). Retaining member 32 defines the wire channels 94 at a rear edge and also defines an axially extending slot 110 extending from the front edge in alignment with the slot 106 in the tubular member 26. Slots 106, 110 are sized relative to the mounting projection 108 to provide an opening 112 between the mounting projection 108 and the end of the slots 106, 110, the purpose of which is described below (see FIG. 4).

Figure 5:
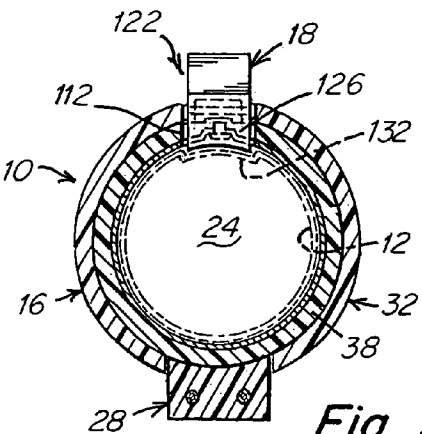
FIG. 5 is a sectional view taken along the line 5-5 in FIG. 4.

Retaining member 32 also includes an axially extending through channel 114 which accommodates connector 28 (see FIG. 5). Retaining member 32 is attached to the first tubular portion 36 of the tubular member 26 by tightening screws 116 which pass through apertures in the retaining member 32 into engagement with the tubular member 26 (see FIG. 7). Screws 116 pass through the tubular member 26 into contact with the locking part 34 to secure the locking part 34 in connection with the tubular member 26.

Locking part 34 includes first and second tubular portions 118, 120 connected together, e.g., via a rivet, and with the second tubular portion 120 having a smaller diameter than the first tubular portion 118 to enable it to fit inside the second tubular portion 38 of the tubular member 26 (see FIG. 4). Mounting projection 108 is formed primarily on the second tubular portion 120. The second tubular portion 120 may be made of a metal.

Locking mechanism 18 includes a release catch 122 having a pressure-application portion 124 at one end and an inwardly extending catch 126 at an opposite end, and is pivotally mounted to the mounting projection 108 at a central region by means of a pivot pin 128 (see FIGS. 4 and 7). Locking mechanism 18 also includes a leaf spring 130 arranged within the mounting projection 108 and between the pressure application portion 124 and the outer-surface of the second tubular portion 120. Leaf spring 130 biases the pressure-application portion 124 upward and thus the catch 126 downward to pass through opening 112 into the passage 24 (see FIG. 4).

Catch 126 is designed to pass into or through an indentation or opening 132 a swaged metal tube of the handle 12 to thereby secure the adapter 10 in connection with the handle 12 (see FIG. 4). As such, to attach the handle 12 to the adapter 10, pressure is applied to the pressure-application portion 124 of the release catch 122 causing the catch 126 to be moved upward and then the handle 12 is urged into the locking part 34. Pressure on the pressure-application portion 124 is released when the catch 126 is aligned with one of the indentations or openings 132 so that the catch 126 moves into the aligning indentation or opening 132 and fixes the handle 12 to the adapter 10. Unintentional separation of the handle 12 from the adapter 10 is thereby prevented since pressure must once again be applied to the pressure-application portion 124 of the release catch 122 to cause the catch 126 to be moved out of the indentation or opening 132. A secure attachment of the handle 12 to the adapter 10 is therefore provided.

Figure 2:
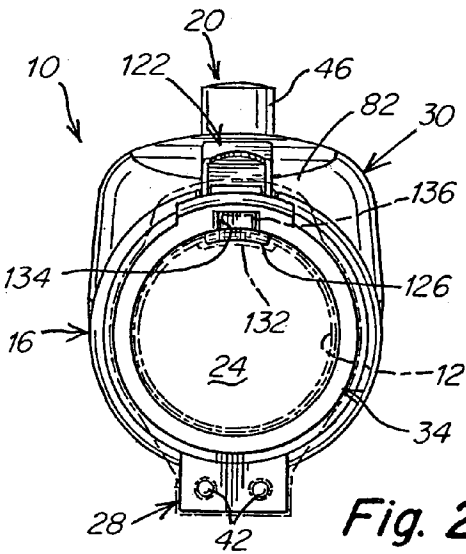
FIG. 2 is a rear elevational view of the wand adapter of FIG. 1

To aid alignment of the adapter 10 with the handle 12, a slot 134 is formed on an inner surface of the locking part 34 to align with a protuberance 136 formed on the metal tube of the handle 12 when the adapter 10 is properly positioned relative to the handle 12 (see FIGS. 2 and 4)

Assembly of the housing 16 involves, in no particular order and non-exclusive, attaching the leaf spring member 44 to the tubular member 26, placing the contacts 98 into the channels 102, attaching the connector 28 to the tubular member 26, guiding the wires 90 along the wire channels 92 into the contacts 98, tightening the screws 100 to secure the wires 90 in engagement with the contacts 98, positioning the button 46 over the leaf spring member 44, attaching the cover 30 to the tubular member 26, attaching the retaining member 32 to the tubular member 26, attaching the release catch 122 to the mounting projection 108 of the locking part 34 and sliding the locking part 34 into engagement with the tubular member 26. The adapter 10 is now ready to be coupled to the handle 12 and the wand implement 14.

Referring now to FIGS. 8-11, another embodiment of a vacuum cleaner wand adapter in accordance with the invention is designated generally as 140. Adapter 140 is similar to or can include similar parts as adapter 10, even if such parts as not shown, e.g., a locking mechanism for releasably locking the adapter 140 to a handle is not shown but can be the same as locking mechanism 18 described above. Adapter 140 can be used for both interconnecting a handle to a wand implement of a vacuum cleaner.

Differing from adapter 10, adapter 140 includes an axially extending slot 142 opening at a front end and which is covered only by the cover 144, a support ledge 146 behind the slot 142 on which the leaf spring member 44 is supported and cooperating positioning and engagement members 148, 150 on the cover 144 and tubular member 152 to secure the cover 144 to the tubular member 152. In addition, tubular contacts 98 are arranged between contact-receiving channels 154, 156 formed on each of the cover 144 and tubular member 152.

Another wand adapter in accordance with the invention designated 160 is shown in FIGS. 12-15 and can be used for interconnecting a handle to a wand implement. Adapter 160 is similar to or can include similar parts as adapters 10, 140, even if such parts as not shown, e.g., a locking mechanism for releasably locking the adapter 160 to a handle is not shown but can be the same as locking mechanism 18 described above.

One particular difference between adapter 160 and adapters 10, 140 is that adapter 160 requires removal of a cover member in order to separate the adapter 10 from the wand implement in view of the absence of a releasable locking mechanism.

Adapter 160 generally comprises a substantially tubular member 162 and a cover 164 detachably connected to the member 162 by a cooperating fastening arrangement. Tubular member 162 includes integral fastening members 166 such as snap fits for enabling the cover 164 to be removably fastened to the tubular member 162. Two pair of fastening members 166 are arranged to engage complementary recesses 168 formed on the underside of the cover 164, one pair at a front of the cover and the other pair at a rear thereof (see FIG. 15). Recesses 168 are formed at the corner between a curved upper wall 170 and substantially planar side walls 172 of the cover 164.

Cover 164 includes a lug 174 projecting on the lower surface of the upper wall 170 and having an inclined surface facing an end of the adapter 160. Lug 174 is designed to contact and pass over a projecting block 176 formed on the wand implement 14 to which the adapter 160 is coupled to thereby secure the adapter 160 thereto (see FIG. 13). Projecting block 176 has an upwardly inclined surface which enables the lug 174 to pass along the surface and over the projecting block 176 (the cover 164 is slightly flexible to allow for the movement of the lug 174 over the projecting block 176). To facilitate engagement of the adapter 160 to the wand implement 14, the tubular member 162 includes an axially extending slot 178 having a width sufficient to accommodate the projecting block 176. Unintentional separation of the adapter 160 from the wand implement 14 is prevented in view of the placement of the lug 174 beyond the projecting block 176 and the cooperating fastening arrangement between the tubular member 162 and the cover 164.

In this embodiment, instead of guiding the wires 90 over the outer surface of the tubular member as in the embodiment shown in FIGS. 1-7, grooves 180 are formed in an outer surface of the tubular member 162 and the wires 90 are positioned or embedded in the grooves 180. This feature can be incorporated into the other embodiments of the invention disclosed herein.

As noted above, since a releasable locking mechanism is not provided, it is not possible to easily separate the adapter 160 from the wand implement 14 it is attached to. Nevertheless, separation of the adapter 160 from the wand implement 14 is still possible by lifting the side walls 172 of the cover 164 in order to disengage the fastening members 166 from the recesses 168. Upon disengagement, the cover 164 is lifted off of the tubular member 162 and thus, the adapter 160 can be separated from the wand implement 14.

A handle assembly for a vacuum cleaner in accordance with the invention can be constructed to include any of adapters 10, 140, 160 described above and a handle having a metal end designed to mate with the adapter. A wand assembly for a vacuum cleaner in accordance with the invention can be constructed to include any of the adapters 10, 140, 160 described above and a wand implement designed to mate with the adapter. Such a handle or wand assembly would be easy to manufacture and conceivably be capable of use in vacuum cleaners of different manufacturers. A vacuum cleaner assembly could also be constructed in accordance with the invention to include any of the adapters 10, 140, 160 described above, a handle having a metal end designed to mate with the adapter at one end and a wand implement designed to mate with the adapter at its other end.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. An adapter for coupling a vacuum cleaner handle to a wand implement, comprising:

a housing defining an inner passage for receiving a portion of the handle and a portion of the wand implement;

first locking means arranged on said housing for releasably locking the handle to said housing;

second locking means arranged on said housing for releasably locking said housing to the wand implement;

a connector for providing electrical connection to conductors of the handle;

electrical contacts for providing electrical connection to contacts of the wand implement, said connector being arranged at one axial end of said housing and said electrical contacts being arranged at an opposite axial end; and wires interconnecting said connector and said electrical contacts, said connector being arranged on the same end of said housing as said first locking means and on a side of said housing opposite said first locking means such that said inner passage is interposed between said connector and said first locking means, said electrical contacts being arranged on the same end of said housing as said second locking means and on the same side of said housing as said first and second locking means and thus on an opposite side from said connector such that said wires pass from one side of said housing to the opposite side of said housing alongside said inner passage.

2. The adapter of claim 1, wherein said first locking means comprise a release catch having a pressure-application portion at one end and a catch at an opposite end, said release catch being arranged on said housing, said release catch being biased such that said catch passes into said passage and is capable of entering into an indentation or opening on the handle to thereby lock the handle to said housing.

3. The adapter of claim 2, wherein said housing includes a locking part having a mounting projection to which said release catch is pivotally mounted.

4. The adapter of claim 3, wherein said first locking means further comprise a leaf spring arranged within said mounting projection to bias said pressure-application portion of said release catch away from said locking part and said catch into the indentation or opening in the handle.

5. The adapter of claim 3, wherein said housing defines an axially extending slot, said mounting projection being accommodated in said slot, said slot defining an opening through which said catch enters into said passage.

6. The adapter of claim 1, wherein said second locking means comprise a leaf spring member and a release button for actuating said leaf spring member, said leaf spring member being mounted to said housing at a first end and having a hook at a second, opposite end, said button being arranged to actuate said leaf spring member between said first and second ends upon being pressed toward said passage to cause said second end to move in a direction away from said passage.

7. The adapter of claim 6, wherein said leaf spring member is biased to urge said button away from said passage.

8. The adapter of claim 6, wherein said housing includes a support ledge, said leaf spring member being arranged to extend over said support ledge such that said hook is on one side of said support ledge and a location at which said button exerts pressure against said leaf spring member is on an opposite side of said support ledge.

9. The adapter of claim 8, wherein said housing include a tubular member which defines said inner passage, said support ledge being part of a coupling part of said housing, said coupling part including said electrical contacts.

10. The adapter of claim 6, wherein said housing has a longitudinally extending slot adapted to accommodate a projecting block of the wand implement, said hook being arranged in said slot.

11. The adapter of claim 1, wherein said housing comprises a tubular member and a cover connected to said member to partially enclose said second locking means and said electrical contacts.

12. The adapter of claim 11, wherein said housing further comprises a C-shaped wire retaining member and a locking part having said first locking means arranged thereon.

13. The adapter of claim 12, wherein said connector is arranged on said tubular member and said retaining member and said tubular member define complementary wire channels through which said wires pass.

14. The adapter of claim 13, wherein said retaining member defines an axially extending channel for accommodating said connector.

15. The adapter of claim 12, wherein said tubular member and said retaining member each define an axially extending slot for accommodating said first locking means.

16. The adapter of claim 1, wherein said electrical contacts are conductive, tubular contacts arranged on said housing and to accommodate the contacts of the wand implement.

17. A vacuum cleaner wand assembly, comprising:

a wand implement including contacts; and an adapter for coupling said implement to a vacuum cleaner handle, said adapter comprising a housing defining an inner passage for receiving a portion of the handle and a portion of said wand implement;

first locking means arranged on said housing for releasably locking the handle to said housing;

second locking means arranged on said housing for releasably locking said housing to said wand implement; and first and second electrical contacts arranged on said housing for providing electrical connection to said contacts of said wand implement, said first and second electrical contacts being spaced apart from one another with a portion of said second locking means being situated therebetween.

18. The wand assembly of claim 17, wherein said second locking means comprise a leaf spring member and a release button for actuating said leaf spring member, said leaf spring member being mounted to said housing at a first end and having a hook at a second, opposite end, said button being arranged to actuate said leaf spring member between said first and second ends upon being pressed toward said passage to cause said second end to move in a direction away from said passage.

19. The adapter of claim 18, wherein said leaf spring member is biased to urge said button away from said passage.

20. The adapter of claim 18, wherein said housing includes a support ledge, said leaf spring member being arranged to extend over said support ledge such that said hook is on one side of said support ledge and a location at which said button exerts pressure against said leaf spring member is on an opposite side of said support ledge.

21. The adapter of claim 20, wherein said housing includes a tubular member which defines said inner passage, said support ledge being part of a coupling part of said housing, said coupling part including said first and second electrical contacts.

22. The adapter of claim 18, wherein said housing has a longitudinally extending slot adapted to accommodate a projecting block of the wand implement, said hook being arranged in said slot.

23. An adapter for coupling a handle of a vacuum cleaner to a wand implement of the vacuum cleaner, comprising:

a housing defining an inner passage for receiving a portion of the wand implement;

locking means arranged on said housing for releasably locking said housing to the wand implement;

a connector arranged on said housing for providing electrical connection to conductors of the handle; and first and second conductive tubular contacts arranged on said housing for providing electrical connection to contacts of the wand implement, said tubular contacts being electrically coupled to said connector and arranged to accommodate the contacts of the wand implement, said first and second contacts being spaced apart from one another with a portion of said locking means being situated therebetween.

24. The adapter of claim 23, further comprising wires interconnecting said connector and said tubular contacts, said wires being electrically connected to said tubular contacts.

25. An adapter for coupling a vacuum cleaner handle to a wand implement, comprising:

a housing defining an inner passage for receiving a portion of the handle and a portion of the wand implement;

first locking means arranged on said housing for releasably locking the handle to said housing; and second locking means arranged on said housing for releasably locking said housing to the wand implement, said second locking means comprising a leaf spring member and a release button for actuating said leaf spring member, said leaf spring member being mounted to said housing at a first end and having a hook at a second, opposite end, said button being arranged to actuate said leaf spring member between said first and second ends upon being pressed toward. said passage to cause said second end to move in a direction away from said passage.

26. An adapter for coupling a vacuum cleaner handle to a wand implement, comprising:

a housing defining an inner passage for receiving a portion of the handle and a portion of the wand implement;

first locking means arranged on said housing for releasabJy locking the handle to said housing; and second locking means arranged on said housing for releasably locking said housing to the wand implement, said housing comprising a tubular member, a cover removably connected to said member to partially enclose said second locking means, and a C-shaped wire retaining member and a locking part having said first locking means arranged thereon.

27. A vacuum cleaner handle assembly, comprising:

a handle having a projecting metal tube; and an adapter for coupling said handle to a wand implement, said adapter comprising a housing defining an inner passage for receiving a portion of said handle and a portion of the wand implement;

first locking means arranged on said housing for releasably locking said handle to said housing; and second locking means arranged on said housing for releasably locking said housing to the wand implement, said second locking means comprising a leaf spring member and a release button for actuating said leaf spring member, said leaf spring member being mounted to said housing at a first end and having a hook at a second, opposite end, said button being arranged to actuate said leaf spring member between said first and second ends upon being pressed toward said passage to cause said second end to move in a direction away from said passage.

28. A vacuum cleaner handle assembly, comprising:

a handle having a projecting metal tube; and an adapter for coupling said handle to a wand implement, said adapter comprising a housing defining an inner passage for receiving a portion of said handle and a portion of the wand implement;

first locking means arranged on said housing for releasably locking said handle to said housing; and second locking means arranged on said housing for releasably locking said housing to the wand implement, said housing comprising a tubular member, a cover removably connected to said member to partially enclose said second locking means, and a C-shaped wire retaining member and a locking part having said first locking means arranged thereon.

29. A vacuum cleaner wand assembly, comprising:

a wand implement; and an adapter for coupling said implement to a vacuum cleaner handle, said adapter comprising a housing defining an inner passage for receiving a portion of the handle and a portion of said wand implement;

first locking means arranged on said housing for releasably locking the handle to said housing; and second locking means arranged on said housing for releasably locking said housing to said wand implement, said second locking means comprising a leaf spring member and a release button for actuating said leaf spring member, said leaf spring member being mounted to said housing at a first end and having a hook at a second, opposite end, said button being arranged to actuate said leaf spring member between said first and second ends upon being pressed toward said passage to cause said second end to move in a direction away from said passage.

* * * * *